US012655498B2

(12) United States Patent
Jablonka et al.

(10) Patent No.: US 12,655,498 B2
(45) Date of Patent: Jun. 16, 2026

(54) PROCESS FOR PRODUCING LITHIUM SALTS

(71) Applicant: Tenova Advanced Technologies Ltd., Yokneam (IL)

(72) Inventors: Mark Stephen Jablonka, Rehovot (IL); Ziv Dee Noor, Haifa (IL); Hani Aharon, Nesher (IL)

(73) Assignee: Tenova Advanced Technologies Ltd., Yokneam (IL)

( * ) Notice: Subject to any disclaimer, the term of this patent is extended or adjusted under 35 U.S.C. 154(b) by 448 days.

(21) Appl. No.: 18/103,075

(22) Filed: Jan. 30, 2023

(65) Prior Publication Data

US 2023/0175100 A1 Jun. 8, 2023

Related U.S. Application Data

(63) Continuation of application No. PCT/IB2022/056964, filed on Aug. 11, 2022.

(30) Foreign Application Priority Data

Aug. 11, 2021 (GB) ..... 2111509

(51) Int. Cl.
*C22B 26/12* (2006.01)
*C22B 3/08* (2006.01)
*C25D 1/02* (2006.01)

(52) U.S. Cl.
CPC ..... *C22B 26/12* (2013.01); *C22B 3/08* (2013.01); *C25D 1/02* (2013.01)

(58) Field of Classification Search
CPC .. C22B 26/12; C22B 3/08; C25D 1/02; C01D 15/00–10
See application file for complete search history.

(56) References Cited

U.S. PATENT DOCUMENTS 10,604,822 B2 3/2020 Lipp
10,995,014 B1 * 5/2021 Fraser ..... C22B 3/1633
2019/0248667 A1 8/2019 Featherstone

FOREIGN PATENT DOCUMENTS

CN 111057848 A 4/2020
WO 2013/065050 A1 5/2013
(Continued)

OTHER PUBLICATIONS

International Search Report for PCT/IB2022/056964 dated Nov. 14, 2022.
Written Opinion for PCT/IB2022/056964 dated Nov. 14, 2022.

*Primary Examiner* — Richard M Rump
(74) *Attorney, Agent, or Firm* — Momentum IP Ltd.; Marc Van Dyke

(57) ABSTRACT

A process for producing a purified aqueous lithium (sulfate) solution including: processing a lithium-containing raw material to produce a crude aqueous solution containing lithium sulfate; contacting the crude solution with an organic medium, in an extraction step to produce a lithium-loaded organic medium and a raffinate; stripping said lithium-loaded organic medium by means of an aqueous acid stripping solution (e.g., sulfuric acid), to extract the lithium cations from the lithium-loaded medium, to produce: the purified aqueous lithium (sulfate) solution and a stripped organic medium; separating the purified lithium solution from the stripped organic medium; recycling the stripped organic medium to the extraction step, the organic medium including the stripped organic medium; subjecting the raffinate to electrolysis to produce: an alkali (sodium) hydroxide solution contaminated with lithium and a sulfuric acid stream; and recycling the alkali hydroxide and sulfuric acid streams for use within the process.

20 Claims, 4 Drawing Sheets

(56) References Cited

FOREIGN PATENT DOCUMENTS

| | | | |
|---|---|---|---|
| WO | 2015/123762 | A1 | 8/2015 |
| WO | 2017/013788 | A1 | 1/2017 |
| WO | 2017/137885 | A1 | 8/2017 |
| WO | 2021/070235 | A1 | 4/2021 |
| WO | 2021/190402 | A1 | 9/2021 |

* cited by examiner

PROCESS FOR PRODUCING LITHIUM SALTS

This application is a continuation of PCT/IB2022/056964 filed on Aug. 11, 2022, which application is incorporated by reference for all purposes as if full set forth herein. PCT/IB2022/056964 draws priority from UK Patent Application No. GB 2111509.2, filed Aug. 11, 2021, which application is incorporated by reference for all purposes as if fully set forth herein.

FIELD AND BACKGROUND OF THE INVENTION

The present invention relates to processes for producing lithium salts, and, more particularly, to processes for concentrating and purifying lithium cations or lithium salts from lithium-containing raw materials.

The present inventors have recognized a need for improved methods for producing lithium salts from various lithium-containing raw materials.

SUMMARY OF THE INVENTION

According to teachings of the present invention there is provided a process for producing a purified aqueous lithium (sulfate) solution including: processing a lithium-containing raw material to produce a crude aqueous solution containing lithium sulfate; contacting the crude solution with an organic medium, in an extraction step to produce a lithium-loaded organic medium and a raffinate; stripping said lithium-loaded organic medium by means of an aqueous acid stripping solution (e.g., sulfuric acid), to extract the lithium cations from the lithium-loaded medium, to produce: the purified aqueous lithium (sulfate) solution and a stripped organic medium; separating the purified lithium solution from the stripped organic medium; recycling the stripped organic medium to the extraction step, the organic medium including the stripped organic medium; subjecting the raffinate to electrolysis to produce: an alkali (sodium) hydroxide solution contaminated with lithium and a sulfuric acid stream; recycling at least a portion of the alkali hydroxide stream for use within the process, optionally to the lithium solvent extraction stage; and recycling at least a portion of the sulfuric acid stream for use within the process.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are used to designate like elements.

In the drawings.

DESCRIPTION OF THE PREFERRED EMBODIMENTS

Figure 1:
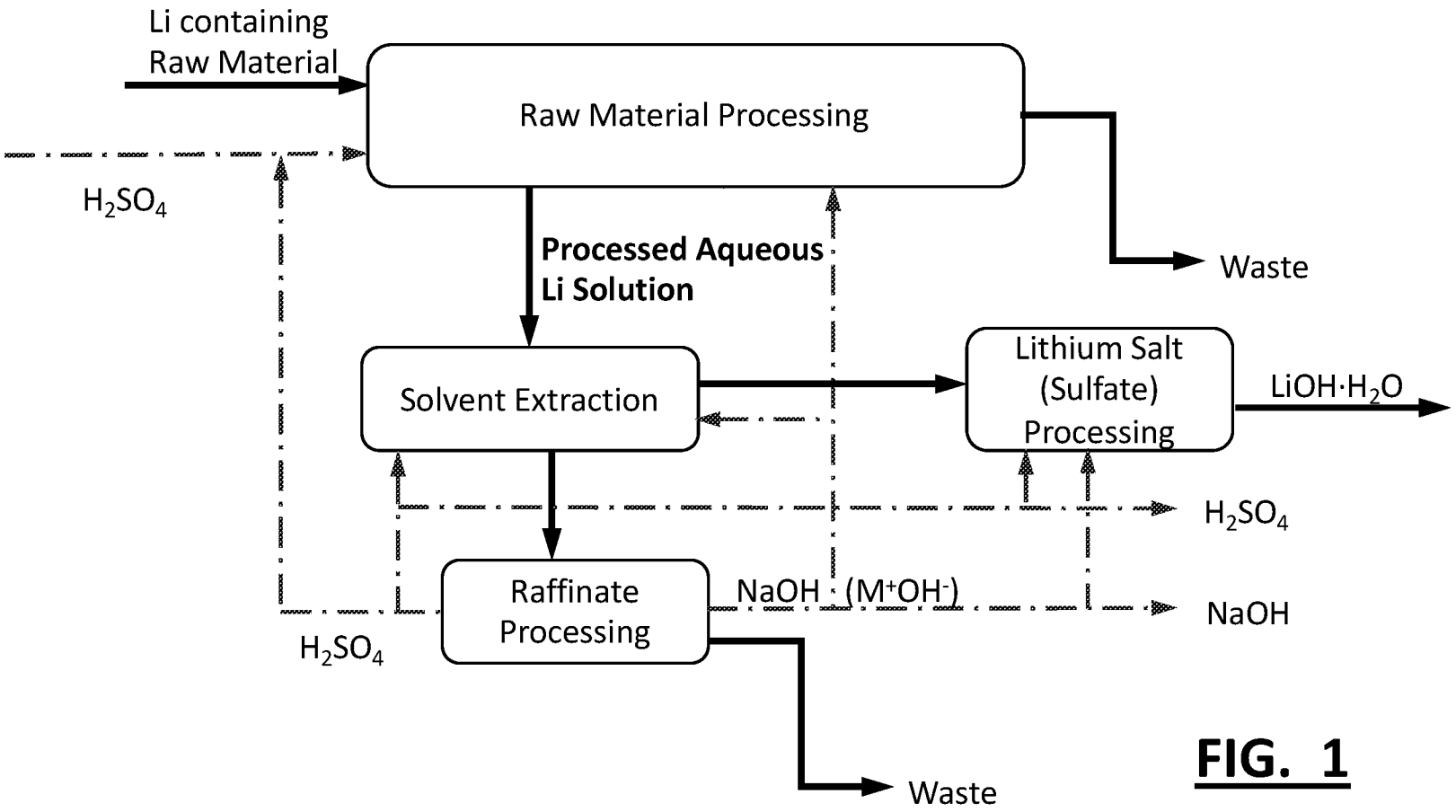
FIG. 1 is a schematic conceptual block diagram of a method of processing a lithium-containing raw material, according to aspects of the present invention.

The principles and operation of the processes according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Also, while sodium, sodium hydroxide and the like are used in the below-provided description, for the purpose of simplification, it must be emphasized that these terms are meant to include all of the heavier alkali metals (e.g., potassium, rubidium, and cesium) and their corresponding hydroxides, respectively.

A method of extracting lithium cations from an aqueous feed solution, followed by stripping, is provided in PCT Patent Publication Nos. WO/2013/065050 and WO/2017/137885, which are incorporated by reference for all purposes as if fully set forth herein. PCT Patent Publication No. WO/2017/137885 also provides for downstream processing of the aqueous lithium solution produced in the stripping operation.

While these methods are fundamentally sound, the present inventors have identified various deficiencies therein. Process economics may be sensitive to the concentration of lithium in the raffinate, which is essentially a waste stream. The present inventors have found that this concentration may be reduced by reducing the lithium-loading concentration in the organic stream discharged from the extraction step. However, this, in turn, increases the recycling in the extraction-stripping train, which deleteriously affects the techno-economics of the process.

In addition, the raffinate waste stream is of a relatively high volume per unit lithium product. This is a high-magnitude issue both from ecological and economic standpoints. In particular, the concentrations—and overall quantities—of sulfate ions and higher alkali ions (sodium, potassium, rubidium, and cesium the raffinate are high.

The inventors have found that by subjecting a treated raffinate stream to electrolysis, the higher alkali ions and sulfate may be recovered as sulfuric acid and alkali hydroxide solution. The sulfuric acid produced may be—disadvantageously—weak, typically around 10% by weight. The sulfuric acid produced may also contain an unacceptably high concentration of alkali impurity.

Similarly, the higher alkali (typically sodium) hydroxide solution produced in the raffinate electrolysis step may also be disadvantageously weak, typically about 20% by weight. While theoretically, a higher concentration may be achieved, the operating cost for doing so may be prohibitively high.

In addition, the higher alkali hydroxide solution produced may be contaminated by various impurities, including lithium.

Finally, the electrolytic process may be appreciably compromised by impurities in the raffinate, including organic matter, multivalent ions, etc.

All of this notwithstanding, the inventors have found that electrolysis of the raffinate may materially contribute to both the economic and ecological viability—which are usually diametrically opposed—of the process. A large portion of both the sulfuric acid and alkali hydroxide solution may be returned to the process, where they may be utilized in place of expensive raw materials (such as concentrated sulfuric acid).

Moreover, concentrated sulfuric acid tends to be contaminated with iron, which is deleterious within the process in general, and in sensitive unit operations such as stripping and ion-exchange in particular. Advantageously, the dilute sulfuric acid discharged from the raffinate electrolysis step may contain appreciably less iron, on a unit $H_2SO_4$ basis.

While the dilute sulfuric acid discharged from the raffinate electrolysis step may contain small amounts of sodium, these amounts are insignificant to tolerable within the various process steps requiring sulfuric acid.

One advantage of the inventive method is that the valuable lithium disposed in the raffinate may be recovered to the process. Significantly, the inventors have discovered that it may be appreciably advantageous to deliberately operate the extraction step with a higher-than-usual lithium loading so at to increase the lithium conversion per pass. While—in the known process—this disadvantageously increases the concentration and amount of lithium in the raffinate waste, the inventive process recycles the "waste" lithium back to the process, within the higher alkali hydroxide solution, thereby enabling a new, more efficient operating point for the extraction step.

Figure 1A:
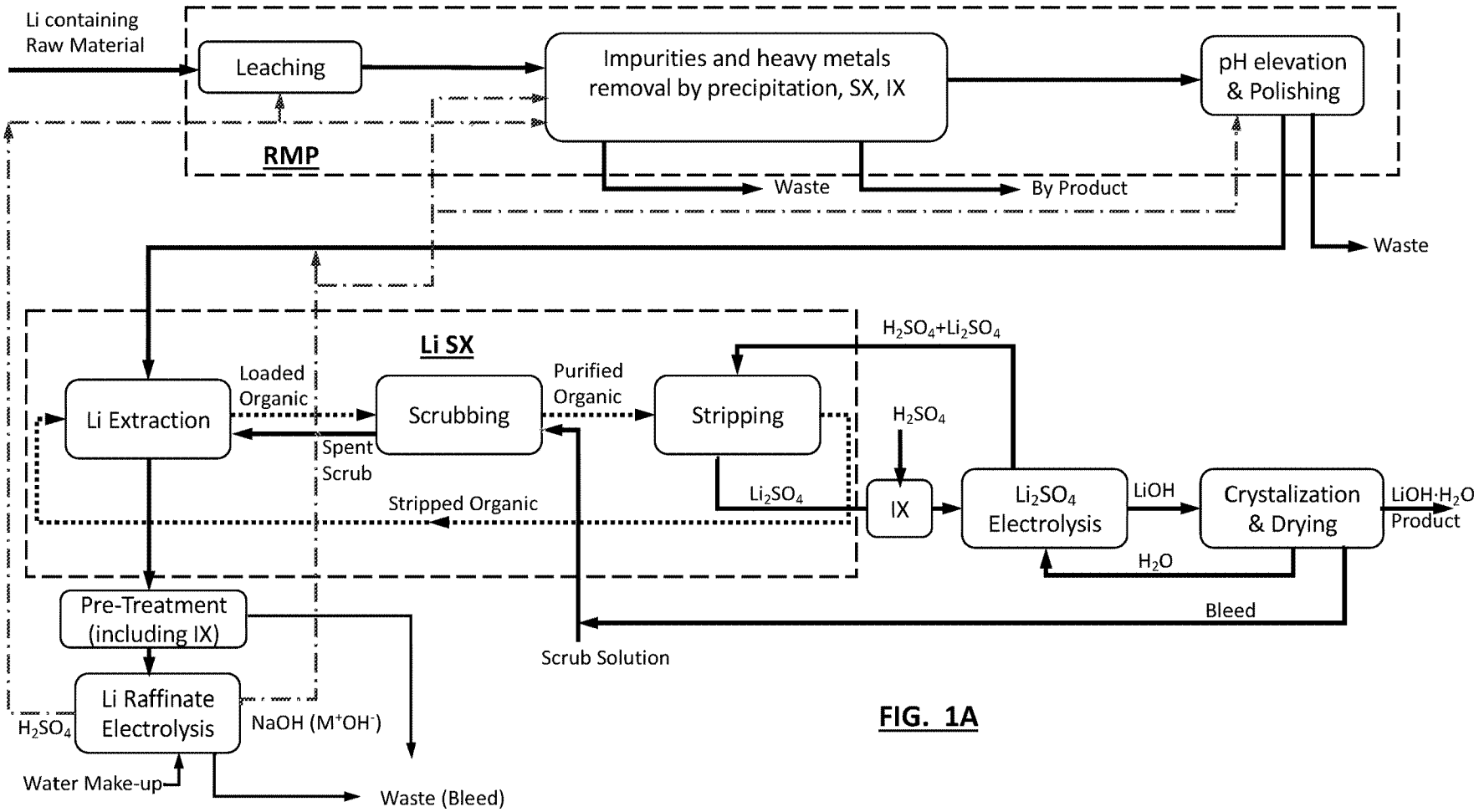
FIG. 1A provides a more detailed schematic flow diagram of a method of processing a lithium-containing raw material, according to aspects of the present invention.
Figure 3:
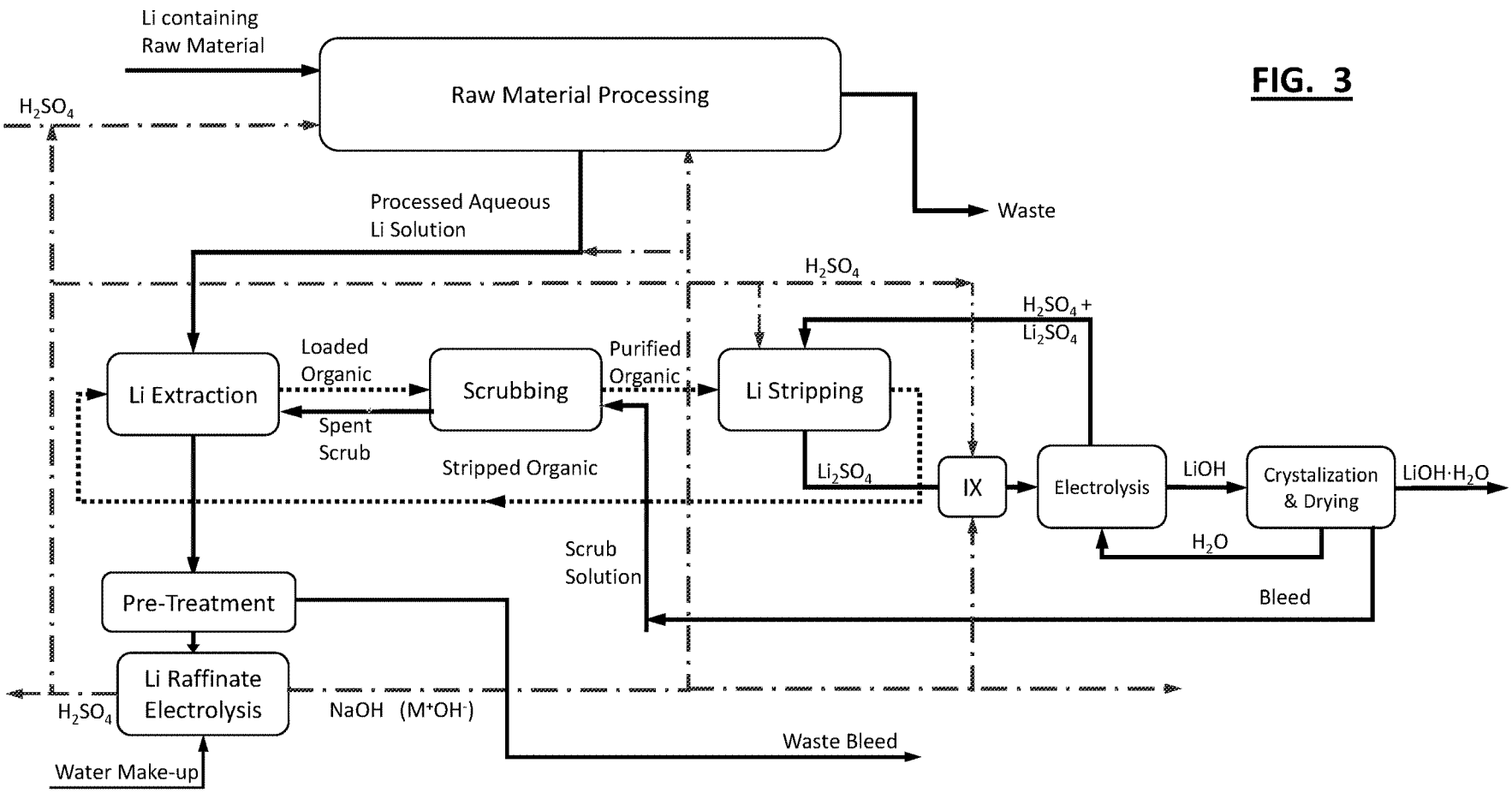
FIG. 3 is a schematic flow diagram of a process for producing a purified aqueous lithium solution such as lithium sulfate and for converting the purified lithium sulfate to lithium hydroxide, according to aspects of the present invention.

Turning now to the figures, FIG. 1 is a schematic conceptual block diagram of a method of processing a lithium-containing raw material, according to teachings of the present invention. FIG. 1A provides a more detailed schematic flow diagram of a method of processing a lithium-containing raw material, according to aspects of the present invention. FIG. 3 is a schematic flow diagram of a process for producing a purified aqueous lithium solution such as lithium sulfate and for converting the purified lithium sulfate to lithium hydroxide, according to aspects of the present invention.

With collective reference to FIG. 1, FIG. 1A, and FIG. 3, the lithium-containing raw material, e.g., a lithium-containing ore such as spodumene ($LiAl(SiO_3)_2$), is processed in a Raw Material Processing (RMP) Stage. Typically, leaching is performed with sulfuric acid. Depending on the lithium-containing raw material, as well as impurities therein, various additional processing steps may be performed. For example, in the case of Ca, Mg, and Al, pH elevation—typically using NaOH—may be utilized to precipitate them out as a hydroxide or—using $Na_2CO_3$—as a carbonate salt precipitate. The precipitate is typically removed as a waste stream. Solvent Extraction (SX) may be used, as is known in the art, for removal of heavy metals (e.g., cobalt, copper, nickel, manganese) present in the lithium-containing raw material. Ion exchange (IX) may be used, as is known in the art, for removal of remaining bi-valent and multi-valent cations, prior to feeding the pregnant lithium sulfate solution into the Lithium Solvent Extraction (Li SX) stage. The sodium and potassium present in the raw materials of the RMP Stage typically behave in a qualitatively similar fashion to the lithium, and are passed on, in solution, to the lithium extraction step described hereinbelow.

One product of the Raw Material Processing Stage may be a processed, aqueous lithium-containing solution that typically contains an appreciable concentration of an alkali metal, typically sodium. This purified solution may be introduced to the lithium Solvent Extraction (Li SX) Stage, which includes an extraction step followed by a stripping step.

In the extraction step, the aqueous lithium-containing solution is mixed with an extracting organic solution to produce a lithium-loaded organic solution. The lithium-loaded organic solution may typically include at least one organic species of the form $R^-$—$Li^+$, wherein $R^-$ is an organic proton acceptor or wherein R is an organic proton donor. This process is highly selective with respect to lithium. All anions, and cations other than lithium (e.g., boron, sodium and potassium) selectively report to the aqueous raffinate.

An appreciable quantity of a higher alkali hydroxide such as NaOH may be required to control pH within the extraction step and—significantly—to condition the extractant.

The lithium-loaded organic phase discharged from the extraction step is optionally washed and scrubbed (as described in greater detail hereinbelow) to selectively remove cationic impurities, before being introduced to the stripping step, in which an aqueous acid (typically $H_2SO_4$, but may be, by way of example, HCl, $H_3PO_4$, $CH_3COOH$, and combinations thereof) may be utilized to liberate the loaded lithium from the organic phase. A relatively pure, aqueous lithium solution may be produced. The organic phase, which may be stripped of nearly all of its lithium, is returned to the extraction step.

The pure, aqueous lithium solution may be further processed to produces various lithium-containing products, as will be appreciated by those of skill in the art. When aqueous lithium sulfate is produced in the stripping step, the solution may undergo further processing in a Lithium Sulfate Processing Stage, which may optionally include purification and may optionally include conversion to lithium hydroxide. The purification typically includes subjecting the aqueous lithium sulfate solution to an IX unit to remove magnesium and calcium values.

Figure 2:
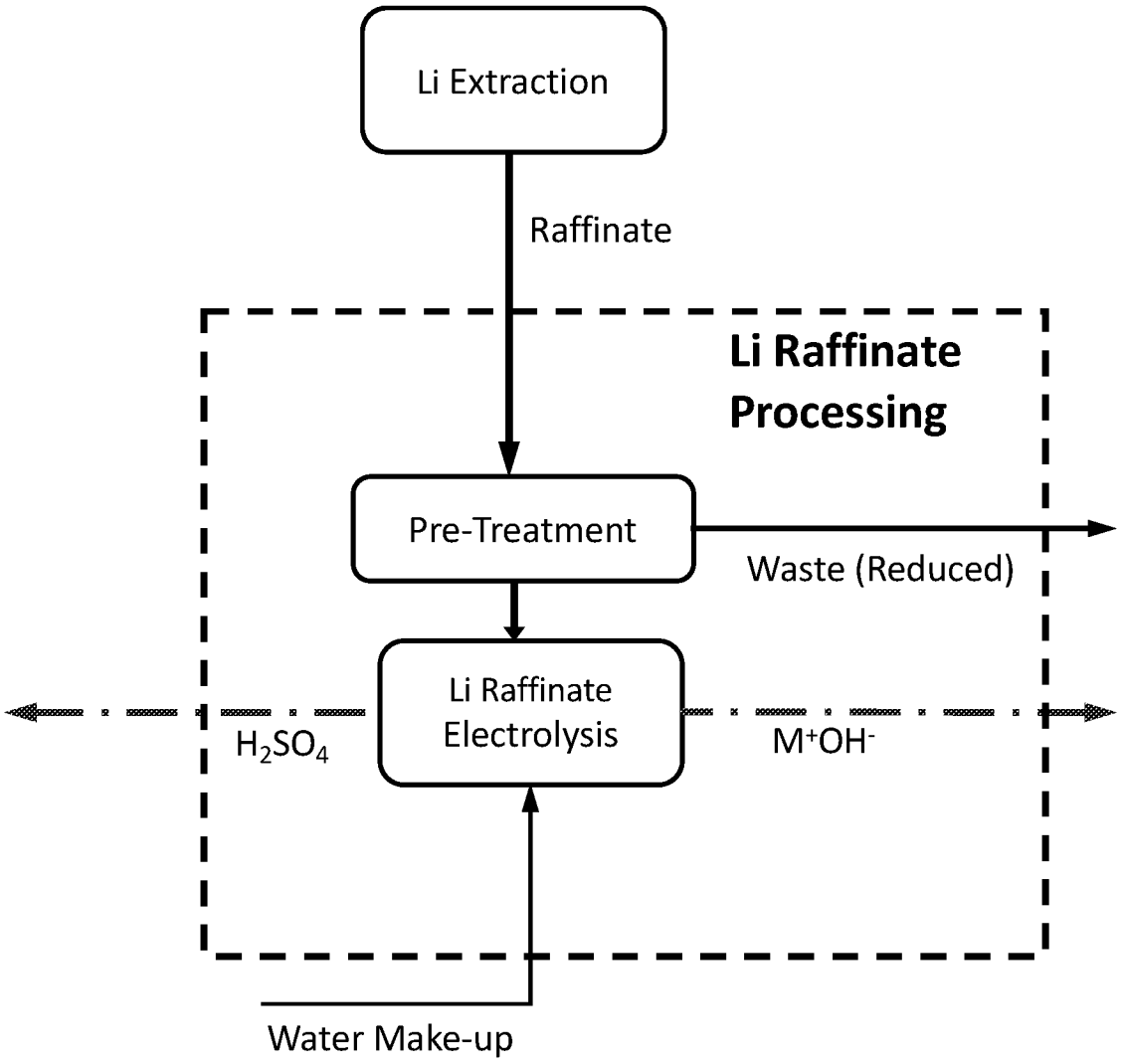
FIG. 2 is a schematic flow diagram of the Raffinate Processing Stage, according to aspects of the present invention.

The Raffinate Processing Stage of the process of the present invention will be better understood with reference to FIG. 2, which provides a schematic flow diagram of the Raffinate Processing Stage, according to teachings of the present invention.

As mentioned hereinabove, the vast majority of lithium ions introduced to the extraction step form an organic species of the form $R^-$—$Li^+$ Consequently, substantially all of the anions introduced to the Solvent Extraction Stage are disposed within the aqueous raffinate. In addition, since the loading of cations onto the $R^-$— species is highly selective with respect to lithium, the vast majority of alkali cations other than lithium (e.g., sodium and potassium) will also be disposed within the aqueous raffinate.

The raffinate further contains a low concentration of lithium, along with some organic matter from the solvent extraction step.

Initially, the raffinate discharged from the lithium extraction step may be subjected to one or more pre-treatment steps, to remove organic matter, silica, etc. The pre-treatment steps may include passing the stream through activated carbon, chemical precipitation (e.g., precipitation of fluoride as $CaF_2$ by means of $Ca^{+2}$), and ion exchange (for removing bi-valent and multi-valent cations), including combinations thereof.

The treated raffinate stream is then introduced to the raffinate electrolysis step, in which the treated raffinate stream may be subjected to electrolysis, typically membrane electrolysis. The raffinate electrolysis step may include a two-compartment or a three-compartment electrolysis cell.

In some embodiments, the electrolysis reaction may proceed substantially according to the following equation:

$$2Na^{+}_{(aq)}+SO_4^{-2}{}_{(aq)}+2H_2O=2H^{+}_{(aq)}+SO_4^{-2}{}_{(aq)}+2Na^{+}_{(aq)}+OH^{-}_{(aq)}$$

As mentioned above, the sulfuric acid produced may be—disadvantageously—dilute, typically ~10% by weight. This may be particularly disadvantageous for sulfuric acid that needs to be transported offsite, and the sulfuric acid may be too dilute for many industrial processes. Moreover, the sulfuric acid produced may also contain an unacceptably high concentration of various impurities, notably alkali metals such as sodium.

These disadvantages notwithstanding, the inventors have found that this dilute, sodium-contaminated sulfuric acid stream is suitable, and often advantageous, for use in various stages within the process, including the Raw Material Processing Stage, the Solvent Extraction Stage, and the optional Lithium Sulfate Processing Stage. This sodium-contaminated sulfuric acid stream may be suitable for leaching operations, stripping operations (including as a make-up source), and ion exchange regeneration.

The inventors have found that various unit operations within the process of the present invention are sensitive to the presence of iron. The inventors have also found that the dilute sulfuric acid discharged from the raffinate electrolysis step may contain appreciably less iron, on a unit $H_2SO_4$ basis, than commercially available concentrated sulfuric acid. Moreover, the inventors have found that the dilute sulfuric acid discharged from the raffinate electrolysis step may replace an appreciable portion of the concentrated sulfuric acid feed, without introducing additional water (or without introducing significant additional water) into the process.

With the recovery of alkali (Mt) hydroxide (such as NaOH) and $H_2SO_4$ from electrolysis of the raffinate, the process as a whole may be appreciably more self-sufficient in terms of NaOH and $H_2SO_4$. If a NaOH make-up stream is nonetheless necessary, and for start-up purposes, the NaOH may typically be introduced to the Solvent Extraction step of the Li SX.

With specific reference now to FIGS. 1A and 3, within the Raw Material Processing stage, the lithium-containing raw material may be leached with sulfuric acid. Various configurations are possible, including heap leaching, dump leaching, and leaching in a stirred tank.

In some embodiments, the lithium-containing raw material includes, mainly includes, consists essentially of or consists of a lithium-containing ore such as petalite ($LiAl(Si_2O_5)_2$), lepidolite ($K(Li,Al)_3(Al,Si,Rb)_4O_{10}(F,OH)_2$), spodumene ($LiAl(SiO_3)_2$), or combinations thereof.

The choice of the lithium-containing raw material(s) may appreciably influence the composition of the impurities present, as well as the concentration of those impurities. Depending on the composition of these impurities, a number of different purification methods may be required. Calcium, magnesium, aluminum and iron may be removed by pH adjustment using sodium hydroxide and/or sodium carbonate (e.g., to precipitate a hydroxide and/or a carbonate salt). In the case of iron, an oxidation step may be required to produce ferric ions, so as to facilitate precipitation.

Nano-filtration may be used as a pre-treatment step to reduce the loading and quantity of reagents, in the precipitation step.

Ion exchange may be advantageous as a post-treatment polishing step.

If any of copper, nickel, cobalt, and manganese are present, solvent extraction may be utilized to purify the solution while obtaining a valuable by-product.

The product solution of the Raw Material Processing stage is a crude aqueous solution containing lithium sulfate, typically at elevated pH. This solution is introduced to the solvent extraction step of the Solvent Extraction stage, in which the crude lithium sulfate solution is contacted with an extracting organic solution to produce a lithium-loaded organic solution and an aqueous raffinate stream.

The lithium-loaded organic solution may include at least one organic species of the form $R^{-}$—$Li^{+}$, wherein $R^{-}$ is an organic proton acceptor or wherein R is an organic proton donor. R may include, mainly include, consists essentially of, or consist of an alcohol, a ketone, an aldehyde, a carboxylic acid, or other organic materials that may be recognized or found to be suitable by those of ordinary skill in the art. Specific examples include isoamyl alcohol, glycerol, methyl-isobutyl ketone (MIBK), thenoyl trifluoroacetone, and benzoyl acetone.

It will be further appreciated by those of ordinary skill in the art that various substitutions may be made in the various species ($R^{-}$) that associate with the lithium ion, such that R or $R^{-}$ may include atoms or ligands other than C, H, and O. For example, substitutions, or in some cases, multiply-substitutions may be made in R or by atoms or ligands such as Cl, Br, I, N, P and S. Typically, Cl, Br, and I may replace hydrogen. N, P and S may be disposed in the backbone or may be attached to the backbone, for example, as part of a branch.

The lithium-loaded organic solution is then stripped by means of an aqueous acid stripping solution, which is typically a sulfuric acid containing stripping solution. Non-limiting examples of the acidic agent in the aqueous acid stripping solution, include at least one of HCl, $H_2SO_4$, $H_3O_4$ and $CH_3COOH$, as disclosed by U.S. Pat. No. 10,604,822B2, which is incorporated in its entirety by reference into the specification, as if fully set forth herein.

In this stripping step, lithium ions are extracted from the organic solution into the aqueous stripping solution, producing a lithium-containing aqueous intermediate solution along with a stripped organic solution. The stripped organic solution is returned to an earlier process step, typically to the lithium extraction step.

The lithium-loaded organic solution is optionally washed and scrubbed with water and a relatively pure lithium-containing solution (e.g., LiOH or $Li_2SO_4$ solution), to further reduce the concentration of potassium and sodium, before reporting to the stripping step, in which the loaded lithium is removed from the organic phase by the aqueous acid stripping solution, to produce a purified lithium (e.g., lithium sulfate) solution. The spent scrub solution may be returned to the solvent extraction step of the Lithium Solvent Extraction stage.

In some embodiments, the lithium-loaded organic solution discharged from the solvent extraction step is introduced directly into the stripping step, i.e., without undergoing an intermediate scrubbing process.

In some embodiments, the purified lithium solution is the lithium product of the process.

In some embodiments, the purified lithium solution is further processed in a Lithium Salt Processing stage, producing—typically—a lithium hydroxide solution and optionally, a lithium hydroxide solid product (lithium hydroxide monohydrate).

In some embodiments, the Lithium Salt Processing stage includes an electrolytic cell producing an aqueous solution of lithium hydroxide from purified lithium sulfate. One exemplary reference for such an electrolysis, which is incorporated by reference into the specification for all purposes, as if fully set forth herein, is disclosed by Ryabtsev et al, "Preparation of High-Purity Lithium Hydroxide Monohydrate from Technical-Grade Lithium Carbonate by Membrane Electrolysis," Russian Journal of Applied Chemistry, Vol. 77, Na. 7, 2004, pp. 1108-1116. Other exemplary references include WO2015123762 and WO2017137885, both of which are incorporated by reference into the specification for all purposes, as if fully set forth herein.

In some embodiments, a two-compartment electrolytic cell (as disclosed in WO2017137885), is utilized.

The two-compartment cell may be operated so as to generate oxygen gas at the anode, producing protons ($H^+$) within the anolyte; and so as to generate hydrogen gas and hydroxide ($OH^-$) at the cathode. Unlike the three-compartment cell, the two-compartment cell is devoid of an anionic membrane, having a cationic membrane disposed between the anodic compartment and the cathodic compartment, and adapted to enable lithium ions to traverse the membrane and pass into the catholyte.

The catholyte, containing $Li^+$ and $OH^-$ values, is removed, typically in continuous fashion, as a product stream from the cathodic compartment. The anolyte from the anodic compartment is recycled to the extraction/stripping train, typically to the stripping stage.

The lithium-rich aqueous solution produced in the stripping stage is introduced to the anodic side and directly contacts the anode. The removal of oxygen at the anode forms $H^+$ ions, thereby increasing the acidity of the anolyte, resulting in an increased $H_2SO_4$ concentration (i.e., increased concentrations of $H^+$ and $SO_4^{-2}$) with respect to the lithium-rich aqueous solution produced in the stripping stage.

Thus, the discharge stream from the anodic compartment contains a solution of sulfuric acid and lithium sulfate. This discharge stream may be recycled/introduced to the stripping step, as shown in FIGS. 1A and 3.

As used herein in the specification and in the claims section that follows, the term "predominant cation", with respect to a solution, refers to a cation having the highest normal concentration within that solution. Except in the sodium hydroxide solutions, the predominant cation is lithium.

As used herein in the specification and in the claims section that follows, the term "predominant anion", with respect to a solution, refers to an anion having the highest normal concentration within that solution. Except in the lithium hydroxide and sodium hydroxide solutions, and in the lithium-containing aqueous intermediate solution produced in the lithium stripping step, when acids other than sulfuric acid are utilized, the predominant anion tends to be sulfate.

As used herein in the specification and in the claims section that follows, the term "membrane electrolysis" is meant to include processes in which ions are transported through at least one ion-exchange membrane under the driving force of a direct current and an applied potential.

As used herein in the specification and in the claims section that follows, the term "$R^-$", with respect to a species "R" having a functional group, refers to a moiety identical to "R", but with one less hydrogen atom at the site of that functional group. Thus, for example, when R is butyric acid ($H_3C—CH_2—CH_2—COOH$), also represented as

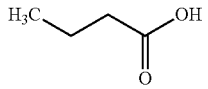

then $R^-$ would be represented by $H_3C—CH_2—CH_2—COO^-$.

As used herein in the specification and in the claims section that follows, the term "percent", or "%", refers to weight-percent, unless specifically indicated otherwise.

Similarly, the term "ratio", as used herein in the specification and in the claims section that follows, refers to a weight ratio, unless specifically indicated otherwise.

Additional Embodiments

Additional Embodiments 1 to 161 are provided hereinbelow:

Embodiment 1. A process for producing a purified aqueous lithium solution from a lithium-containing raw material, the process comprising: (a) processing the lithium-containing raw material to produce a crude aqueous solution containing lithium sulfate; (b) in the presence of at least one alkali (M+) hydroxide, contacting the crude aqueous solution with a first organic medium, in an extraction step of a lithium solvent extraction stage, to produce: (i) a lithium-loaded organic medium; and (ii) a raffinate; wherein $M^+$ is selected from the group consisting of sodium, potassium, rubidium, and cesium; (c) in a stripping step of the lithium solvent extraction stage, stripping the lithium-loaded organic medium by means of an aqueous stripping solution containing an acid, to extract the lithium cations from the lithium-loaded organic medium, producing: (i) the purified aqueous lithium solution; and (ii) a stripped organic medium; (d) separating the purified aqueous lithium solution from the stripped organic medium; (e) recycling the stripped organic medium to the lithium solvent extraction stage, the first organic medium including the stripped organic medium; (f) subjecting the raffinate to electrolysis in a raffinate electrolysis step to produce: (i) a hydroxide solution containing the alkali hydroxide, and contaminated with lithium; and (ii) a sulfuric acid stream; (g) recycling at least a portion of the hydroxide solution for use within the process, optionally to the lithium solvent extraction stage; and (h) recycling at least a portion of the sulfuric acid stream for use within the process.

Embodiment 2. A process for producing a purified aqueous lithium solution from a crude aqueous solution containing lithium sulfate, the process comprising: (a) contacting the crude aqueous solution with a first organic medium, in an extraction step of a solvent extraction stage, to produce: (i) a lithium-loaded organic medium; and (ii) a raffinate; (b) in a stripping step of the lithium solvent extraction stage, stripping the lithium-loaded organic medium by means of an aqueous acid stripping solution, to extract the lithium cations from the lithium-loaded organic medium, producing: (i) the purified aqueous lithium solution; and (ii) a stripped organic medium; (c) separating the purified aqueous lithium solution from the stripped organic medium; (d) recycling the stripped organic medium to the lithium solvent extraction stage, the first organic medium including the stripped organic medium; (e) subjecting the raffinate to electrolysis in a raffinate electrolysis step to produce: (i) a hydroxide solution containing at least one alkali (M+) hydroxide, and contaminated with lithium, wherein $M^+$ is selected from the group consisting of sodium, potassium, rubidium, and cesium; and (ii) a sulfuric acid stream; (f) recycling at least a portion of the hydroxide solution for use within the process, optionally to the lithium solvent extraction stage; and optionally (g) recycling at least a portion of the sulfuric acid stream for use within the process.

Embodiment 2A. The process of Embodiment 2, wherein the contacting is performed in the presence of said M+ hydroxide.

Embodiment 3. The process of any one of the preceding Embodiments, further comprising separating the lithium-loaded organic medium from the raffinate.

Embodiment 4. The process of any one of the preceding Embodiments, wherein the lithium-loaded organic medium is directly introduced into the stripping step, without undergoing intermediate scrubbing.

Embodiment 5. The process of any one of Embodiments 1 to 3, further comprising, prior to the stripping, purifying the lithium-loaded organic medium in a scrubbing stage.

Embodiment 6. The process of any one of the preceding Embodiments, further comprising, prior to the subjecting the raffinate to electrolysis, removing organic matter from the raffinate.

Embodiment 7. The process of any one of the preceding Embodiments, further comprising subjecting the purified lithium sulfate solution to electrolysis to produce lithium hydroxide.

Embodiment 8. The process of any one of the preceding Embodiments, wherein the concentration of $M^+$ within the hydroxide solution is at most 35%.

Embodiment 9. The process of Embodiment 8, wherein the concentration of $M^+$ within the hydroxide solution is at most 25%.

Embodiment 10. The process of Embodiment 8, wherein the concentration of $M^+$ within the hydroxide solution is at most 22%.

Embodiment 11. The process of Embodiment 8, wherein the concentration of $M^+$ within the hydroxide solution is at most 20%.

Embodiment 12. The process of any one of Embodiments 1 to 7, wherein the concentration of $M^+$ within the hydroxide solution is within the range of 8% to 35%.

Embodiment 13. The process of any one of Embodiments 1 to 7, wherein the concentration of $M^+$ within the hydroxide solution is within the range of 8% to 32%, 8% to 30%, 8% to 25%, 8% to 22%, 10% to 35%, 10% to 30%, 10% to 25%, or 10% to 22%.

Embodiment 14. The process of any one of Embodiments 1 to 7, wherein the concentration of $M^+$ within the hydroxide solution is within the range of 12% to 35%.

Embodiment 15. The process of any one of Embodiments 1 to 7, wherein the concentration of $M^+$ within the hydroxide solution is within the range of 12% to 25%.

Embodiment 16. The process of any one of Embodiments 1 to 7, wherein the concentration of $M^+$ within the hydroxide solution is within the range of 12% to 22%, 15% to 35%, or 15% to 22%.

Embodiment 17. The process of any one of Embodiments 1 to 7, wherein the concentration of $M^+$ within the hydroxide solution is within the range of 15% to 25%.

Embodiment 18. The process of any one of the preceding Embodiments, wherein the concentration of sulfuric acid within the sulfuric acid stream is at most 18%.

Embodiment 19. The process of any one of the preceding Embodiments, wherein the concentration of sulfuric acid within the sulfuric acid stream is at most 15%.

Embodiment 20. The process of any one of the preceding Embodiments, wherein the concentration of sulfuric acid within the sulfuric acid stream is at most 12%.

Embodiment 21. The process of any one of the preceding Embodiments, wherein the concentration of sulfuric acid within the sulfuric acid stream is at most 10%.

Embodiment 22. The process of any one of Embodiments 1 to 17, wherein the concentration of sulfuric acid within the sulfuric acid stream is within the range of 6% to 20%.

Embodiment 23. The process of any one of Embodiments 1 to 17, wherein the concentration of sulfuric acid within the sulfuric acid stream is within the range of 6% to 17%.

Embodiment 24. The process of any one of Embodiments 1 to 17, wherein the concentration of sulfuric acid within the sulfuric acid stream is within the range of 6% to 15%.

Embodiment 25. The process of any one of Embodiments 1 to 17, wherein the concentration of sulfuric acid within the sulfuric acid stream is within the range of 6% to 12%.

Embodiment 26. The process of any one of Embodiments 18 to 25, wherein the concentration of sulfuric acid within the sulfuric acid stream is at least 8%.

Embodiment 27. The process of any one of Embodiments 1 to 17, wherein the concentration of sulfuric acid within the sulfuric acid stream is within the range of 7% to 20%, 7% to 17%, 7% to 15%, 7% to 12%, 9% to 20%, 9% to 17%, 9% to 15%, or 9% to 12%.

Embodiment 28. The process of any one of the preceding Embodiments, further comprising separating the lithium-containing aqueous intermediate solution from the stripped organic medium.

Embodiment 29. The process of any one of the preceding Embodiments, wherein a portion of sulfuric acid in the sulfuric acid stream is recycled to the stripping step.

Embodiment 30. The process of any one of the preceding Embodiments, wherein a portion of sulfuric acid in the sulfuric acid stream is utilized within the process to regenerate an ion-exchange resin.

Embodiment 31. The process of any one of the preceding Embodiments, wherein a portion of sulfuric acid in the sulfuric acid stream is utilized in a leaching step within the process.

Embodiment 32. The process of any one of the preceding Embodiments, wherein a portion of the alkali hydroxide in the alkali hydroxide solution is utilized to produce the crude aqueous solution containing lithium sulfate.

Embodiment 33. The process of any one of the preceding Embodiments, wherein a portion of the alkali hydroxide in the alkali hydroxide solution is introduced to the lithium solvent extraction stage.

Embodiment 34. The process of any one of the preceding Embodiments, further comprising regenerating an ion exchange unit within the process using a portion of the alkali hydroxide in the alkali hydroxide solution.

Embodiment 35. The process of any one of the preceding Embodiments, wherein the concentration of organic matter within the raffinate is at least 10 ppm.

Embodiment 36. The process of Embodiment 35, wherein the concentration of organic matter within the raffinate is at least 20 ppm.

Embodiment 37. The process of Embodiment 35, wherein the concentration of organic matter within the raffinate is at least 40 ppm.

Embodiment 38. The process of Embodiment 35, wherein the concentration of organic matter within the raffinate is at least 100 ppm.

Embodiment 39. The process of any one of Embodiments 1 to 34, wherein the concentration of organic matter within the raffinate is within the range of 10 to 1000 ppm.

Embodiment 40. The process of any one of Embodiments 1 to 34, wherein the concentration of organic matter within the raffinate is within the range of 10 to 600 ppm.

Embodiment 41. The process of any one of Embodiments 1 to 34, wherein the concentration of organic matter within the raffinate is within the range of 20 to 350 ppm.

Embodiment 42. The process of any one of Embodiments 1 to 34, wherein the concentration of organic matter within the raffinate is within the range of 40 to 250 ppm.

Embodiment 43. The process of any of the preceding Embodiments, wherein the concentration of lithium within the raffinate is at least 2 ppm.

Embodiment 44. The process of Embodiment 43, wherein the concentration of lithium within the raffinate is at least 3 ppm.

Embodiment 45. The process of Embodiment 43, wherein the concentration of lithium within the raffinate is at least 5 ppm.

Embodiment 46. The process of Embodiment 43, wherein the concentration of lithium within the raffinate is at least 10 ppm.

Embodiment 47. The process of Embodiment 43, wherein the concentration of lithium within the raffinate is at least 20 ppm.

Embodiment 48. The process of Embodiment 43, wherein the concentration of lithium within the raffinate is at least 35 ppm.

Embodiment 49. The process of Embodiment 43, wherein the concentration of lithium within the raffinate is at least 50 ppm.

Embodiment 50. The process of Embodiment 43, wherein the concentration of lithium within the raffinate is at least 75 ppm.

Embodiment 51. The process of any one of Embodiments 43 to 50, wherein the concentration of lithium within the raffinate is at most 2000 ppm.

Embodiment 52. The process of any one of Embodiments 43 to 50, wherein the concentration of lithium within the raffinate is at most 1000 ppm.

Embodiment 53. The process of any one of Embodiments 43 to 50, wherein the concentration of lithium within the raffinate is at most 600 ppm.

Embodiment 54. The process of any one of Embodiments 43 to 50, wherein the concentration of lithium within the raffinate is at most 350 ppm.

Embodiment 55. The process of any one of Embodiments 43 to 50, wherein the concentration of lithium within the raffinate is at most 200 ppm.

Embodiment 56. The process of any one of Embodiments 43 to 50, wherein the concentration of lithium within the raffinate is at most 125 ppm.

Embodiment 57. The process of any one of Embodiments 1 to 42, wherein the concentration of lithium within the raffinate is within the range of 5 to 2000 ppm, 10 to 2000 ppm, 10 to 1000 ppm, 10 to 600 ppm, 10 to 200 ppm, 20 to 2000 ppm, 20 to 1000 ppm, 20 to 600 ppm, 20 to 200 ppm, 20 to 100 ppm, 40 to 2000 ppm, 40 to 1000 ppm, 40 to 600 ppm, 40 to 200 ppm, 40 to 100 ppm, or 75 to 1000 ppm.

Embodiment 58. The process of any one of Embodiments 1 to 57, wherein the concentration of lithium within the raffinate is at least 2% of the concentration of lithium within the lithium-loaded organic medium.

Embodiment 59. The process of any one of Embodiments 1 to 57, wherein the concentration of lithium within the raffinate is at least 2.5% of the concentration of lithium within the lithium-loaded organic medium.

Embodiment 60. The process of any one of Embodiments 1 to 57, wherein the concentration of lithium within the raffinate is at least 3% of the concentration of lithium within the lithium-loaded organic medium.

Embodiment 61. The process of any one of Embodiments 1 to 57, wherein the concentration of lithium within the raffinate is at least 3.5% of the concentration of lithium within the lithium-loaded organic medium.

Embodiment 62. The process of any one of Embodiments 1 to 57, wherein the concentration of lithium within the raffinate is at least 4% of the concentration of lithium within the lithium-loaded organic medium.

Embodiment 63. The process of any one of Embodiments 1 to 57, wherein the concentration of lithium within the raffinate is at least 5% of the concentration of lithium within the lithium-loaded organic medium.

Embodiment 64. The process of any one of Embodiments 1 to 57, wherein the concentration of lithium within the raffinate is at least 7% of the concentration of lithium within the lithium-loaded organic medium.

Embodiment 65. The process of any one of Embodiments 1 to 57, wherein the concentration of lithium within the raffinate is at least 10% of the concentration of lithium within the lithium-loaded organic medium.

Embodiment 66. The process of any one of Embodiments 58 to 65, wherein the concentration of lithium within the raffinate is at most 20% of the concentration of lithium within the lithium-loaded organic medium.

Embodiment 67. The process of Embodiment 66, wherein the concentration of lithium within the raffinate is at most 15% of the concentration of lithium within the lithium-loaded organic medium.

Embodiment 68. The process of Embodiment 66, wherein the concentration of lithium within the raffinate is at most 12% of the concentration of lithium within the lithium-loaded organic medium.

Embodiment 69. The process of any one of Embodiments 1 to 57, wherein the concentration of lithium within the raffinate is within the range of 2% to 20%, 2.5% to 20%, 3% to 20%, 3.5% to 20%, 4% to 20%, 5% to 20%, 2% to 15%, 2.5% to 15%, 3% to 15%, 3.5% to 15%, 4% to 15%, 5% to 15%, 2% to 12%, 2.5% to 12%, 3% to 12%, 3.5% to 12%, 4% to 12%, 5% to 12%, 2% to 10%, 2.5% to 10%, 3% to 10%, 3.5% to 10%, 4% to 10%, or 5% to 10% of the concentration of lithium within the lithium-loaded organic medium.

Embodiment 70. The process of any one of the preceding Embodiments, wherein the concentration of lithium within the alkali hydroxide solution is at least 4 ppm.

Embodiment 71. The process of Embodiment 70, wherein the concentration of lithium within the alkali hydroxide solution is at least 7 ppm.

Embodiment 72. The process of Embodiment 70, wherein the concentration of lithium within the alkali hydroxide solution is at least 10 ppm.

Embodiment 73. The process of Embodiment 70, wherein the concentration of lithium within the alkali hydroxide solution is at least 20 ppm.

Embodiment 74. The process of Embodiment 70, wherein the concentration of lithium within the alkali hydroxide solution is at least 40 ppm.

Embodiment 75. The process of Embodiment 70, wherein the concentration of lithium within the alkali hydroxide solution is at least 100 ppm.

Embodiment 76. The process of any one of Embodiments 70 to 75, wherein the concentration of lithium within the alkali hydroxide solution is at most 5000 ppm.

Embodiment 77. The process of any one of Embodiments 70 to 75, wherein the concentration of lithium within the alkali hydroxide solution is at most 2000 ppm.

Embodiment 78. The process of any one of Embodiments 70 to 75, wherein the concentration of lithium within the alkali hydroxide solution is at most 1000 ppm.

Embodiment 79. The process of any one of Embodiments 70 to 75, wherein the concentration of lithium within the alkali hydroxide solution is at most 600 ppm.

Embodiment 80. The process of any one of Embodiments 70 to 75, wherein the concentration of lithium within the alkali hydroxide solution is at most 350 ppm.

Embodiment 81. The process of any one of Embodiments 70 to 75, wherein the concentration of lithium within the alkali hydroxide solution is at most 200 ppm.

Embodiment 82. The process of any one of Embodiments 1 to 69, wherein the concentration of lithium within the alkali hydroxide solution is within the range of 4 to 5000 ppm, 4 to 2000 ppm, 4 to 1000 ppm, 5 to 5000 ppm, 10 to 2000 ppm, 10 to 1000 ppm, 10 to 600 ppm, 10 to 200 ppm, 20 to 5000 ppm, 20 to 2000 ppm, 20 to 1000 ppm, 20 to 600 ppm, 20 to 200 ppm, 20 to 100 ppm, 40 to 5000 ppm, 40 to 2000 ppm, 40 to 1000 ppm, 40 to 600 ppm, 40 to 200 ppm, 40 to 100 ppm, 60 to 5000 ppm, 60 to 2000 ppm, 60 to 1000 ppm, 60 to 600 ppm, or 100 to 2000 ppm.

Embodiment 83. The process of any one of the preceding Embodiments, wherein the concentration of iron within the sulfuric acid stream is at most 10 ppm.

Embodiment 84. The process of Embodiment 83, wherein the concentration of iron within the sulfuric acid stream is at most 5 ppm.

Embodiment 85. The process of Embodiment 83, wherein the concentration of iron within the sulfuric acid stream is at most 2 ppm.

Embodiment 86. The process of Embodiment 83, wherein the concentration of iron within the sulfuric acid stream is at most 1 ppm.

Embodiment 87. The process of Embodiment 83, wherein the concentration of iron within the sulfuric acid stream is at most 0.5 ppm.

Embodiment 88. The process of any one of the preceding Embodiments, wherein the concentration of sodium within the sulfuric acid stream is at least 50 ppm.

Embodiment 89. The process of Embodiment 88, wherein the concentration of sodium within the sulfuric acid stream is at least 75 ppm.

Embodiment 90. The process of Embodiment 88, wherein the concentration of sodium within the sulfuric acid stream is at least 100 ppm.

Embodiment 91. The process of Embodiment 88, wherein the concentration of sodium within the sulfuric acid stream is at least 200 ppm.

Embodiment 92. The process of Embodiment 88, wherein the concentration of sodium within the sulfuric acid stream is at least 500 ppm.

Embodiment 93. The process of Embodiment 88, wherein the concentration of sodium within the sulfuric acid stream is at least 800 ppm.

Embodiment 94. The process of any one of the preceding Embodiments, wherein the concentration of sodium within the sulfuric acid stream is at most 5000 ppm.

Embodiment 95. The process of any one of the preceding Embodiments, wherein the concentration of sodium within the sulfuric acid stream is at most 3000 ppm.

Embodiment 96. The process of any one of the preceding Embodiments, wherein the concentration of sodium within the sulfuric acid stream is at most 2000 ppm.

Embodiment 97. The process of any one of the preceding Embodiments, wherein the concentration of sodium within the sulfuric acid stream is at most 1500 ppm.

Embodiment 98. The process of any one of the preceding Embodiments, wherein the utilization of the alkali hydroxide solution within the process is at least 20%.

Embodiment 99. The process of Embodiment 98, wherein the utilization of the alkali hydroxide solution within the process is at least 30%.

Embodiment 100. The process of Embodiment 98, wherein the utilization of the alkali hydroxide solution within the process is at least 35%, at least 40%, or at least 50%.

Embodiment 101. The process of Embodiment 98, wherein the utilization of the alkali hydroxide solution within the process is at least 60%.

Embodiment 102. The process of Embodiment 98, wherein the utilization of the alkali hydroxide solution within the process is at least 70%.

Embodiment 103. The process of Embodiment 98, wherein the utilization of the alkali hydroxide solution within the process is at least 80%.

Embodiment 104. The process of Embodiment 98, wherein the utilization of the alkali hydroxide solution within the process is at least 90%.

Embodiment 105. The process of any one of Embodiments 1 to 98, wherein the total utilization of the alkali hydroxide solution within the raw material processing stage and the lithium solvent extraction stage is at least 15%.

Embodiment 106. The process of Embodiment 98, wherein the total utilization of the alkali hydroxide solution within the raw material processing stage and the lithium solvent extraction stage is at least 20%.

Embodiment 107. The process of Embodiment 98, wherein the total utilization of the alkali hydroxide solution within the raw material processing stage and the lithium solvent extraction stage is at least 35%.

Embodiment 108. The process of Embodiment 98, wherein the total utilization of the alkali hydroxide solution within the raw material processing stage and the lithium solvent extraction stage is at least 50%.

Embodiment 109. The process of Embodiment 98, wherein the total utilization of the alkali hydroxide solution within the raw material processing stage and the lithium solvent extraction stage is at least 60%.

Embodiment 110. The process of Embodiment 98, wherein the total utilization of the alkali hydroxide solution within the raw material processing stage and the lithium solvent extraction stage is at least 70%.

Embodiment 111. The process of Embodiment 98, wherein the total utilization of the alkali hydroxide solution within the raw material processing stage and the lithium solvent extraction stage is at least 80%.

Embodiment 112. The process of Embodiment 98, wherein the total utilization of the alkali hydroxide solution within the raw material processing stage and the lithium solvent extraction stage is at least 85%.

Embodiment 113. The process of any one of the preceding Embodiments, wherein the utilization of the sulfuric acid stream within the process is at least 20%.

Embodiment 114. The process of Embodiment 113, wherein the utilization of the sulfuric acid stream within the process is at least 35%.

Embodiment 115. The process of Embodiment 113, wherein the utilization of the sulfuric acid stream within the process is at least 50%.

Embodiment 116. The process of Embodiment 113, wherein the utilization of the sulfuric acid stream within the process is at least 60%.

Embodiment 117. The process of Embodiment 113, wherein the utilization of the sulfuric acid stream within the process is at least 70%.

Embodiment 118. The process of Embodiment 113, wherein the utilization of the sulfuric acid stream within the process is at least 80%.

Embodiment 119. The process of Embodiment 113, wherein the utilization of the sulfuric acid stream within the process is at least 90%.

Embodiment 120. The process of any one of Embodiment 1 to 112, wherein the total utilization of the sulfuric acid stream within the raw material processing stage and the lithium solvent extraction stage is at least 15%.

Embodiment 121. The process of Embodiment 120, wherein the total utilization of the sulfuric acid stream within the raw material processing stage and the lithium solvent extraction stage is at least 20%.

Embodiment 122. The process of Embodiment 120, wherein the total utilization of the sulfuric acid stream within the raw material processing stage and the lithium solvent extraction stage is at least 35%.

Embodiment 123. The process of Embodiment 120, wherein the total utilization of the sulfuric acid stream within the raw material processing stage and the lithium solvent extraction stage is at least 50%.

Embodiment 124. The process of Embodiment 120, wherein the total utilization of the sulfuric acid stream within the raw material processing stage and the lithium solvent extraction stage is at least 60%.

Embodiment 125. The process of Embodiment 120, wherein the total utilization of the sulfuric acid stream within the raw material processing stage and the lithium solvent extraction stage is at least 70%.

Embodiment 126. The process of Embodiment 120, wherein the total utilization of the sulfuric acid stream within the raw material processing stage and the lithium solvent extraction stage is at least 80%.

Embodiment 127. The process of Embodiment 120, wherein the total utilization of the sulfuric acid stream within the raw material processing stage and the lithium solvent extraction stage is at least 85%.

Embodiment 128. The process of any one of the preceding Embodiments, further comprising introducing the purified lithium sulfate solution into a lithium sulfate processing stage, to produce lithium hydroxide.

Embodiment 129. The process of any one of the preceding Embodiments, wherein the purified lithium sulfate solution is subjected to electrolysis in an electrolytic cell, to produce a solution of lithium hydroxide.

Embodiment 130. The process of Embodiment 129, wherein the solution of lithium hydroxide is crystallized in a crystallization step to produce lithium hydroxide monohydrate.

Embodiment 131. The process of Embodiment 130, wherein a bleed from the crystallization step is returned to the lithium solvent extraction stage.

Embodiment 132. The process of any one of Embodiments 129 to 131, further comprising recycling a discharge stream from an anodic compartment of the electrolytic cell, for use in the in the stripping step of the lithium solvent extraction stage.

Embodiment 133. The process of any one of the preceding Embodiments, wherein the processing of the lithium-containing raw material includes adding a base to produce the crude aqueous solution, the crude aqueous solution having a pH within a range of 10 to 14.

Embodiment 134. The process of any one of the preceding Embodiments, wherein the processing of the lithium-containing raw material includes leaching the lithium-containing raw material with sulfuric acid.

Embodiment 135. The process of Embodiment 134, wherein a portion of the sulfuric acid used to effect the leaching of the lithium-containing raw material is utilized from the sulfuric acid stream.

Embodiment 136. The process of any one of the preceding Embodiments, wherein the lithium-containing raw material includes, or consists essentially of, a lithium ore.

Embodiment 137. The process of Embodiment 136, wherein the lithium ore includes, or consists essentially of, spodumene.

Embodiment 138. The process of Embodiment 136, wherein the lithium ore includes, or consists essentially of, petalite $[LiAl(Si_2O_5)_2]$.

Embodiment 139. The process of Embodiment 136, wherein the lithium ore includes, or consists essentially of, lepidolite $[K(Li,Al)_3(Al,Si,Rb)_4O_{10}(F,OH)_2]$.

Embodiment 140. The process of any one of the preceding Embodiments, wherein the lithium-containing raw material includes, or consists essentially of, a lithium-containing waste or lithium-containing recycled material.

Embodiment 141. The process of any one of the preceding Embodiments, wherein the organic to acid volumetric ratio is within the range of 20:1-1:20.

Embodiment 142. The process of any one of the preceding Embodiments, wherein the lithium-loaded organic medium includes at least one organic species of the form $R^-$ —$Li^+$, wherein $R^-$ is an organic proton acceptor or wherein R is an organic proton donor.

Embodiment 143. The process of Embodiment 142, wherein R includes, mainly includes, consists essentially of, or consists of an alcohol.

Embodiment 144. The process of Embodiment 142, wherein the alcohol includes at least one alcohol selected from the group consisting of a straight-chain alcohol, a branched alcohol, and a diol or polyol.

Embodiment 145. The process of Embodiment 142, wherein the alcohol includes at least one $C_1$-$C_{10}$ alcohol.

Embodiment 146. The process of Embodiment 142, wherein R includes, mainly includes, consists essentially of, or consists of a ketone.

Embodiment 147. The process of Embodiment 146, wherein the ketone includes at least one ketone selected from the group consisting of a straight-chain ketone, a branched ketone, and a diketone or a polyketone.

Embodiment 148. The process of Embodiment 146 or 147, wherein the ketone includes at least one $C_3$-$C_{10}$ ketone.

Embodiment 149. The process of Embodiment 142, wherein R includes, mainly includes, consists essentially of, or consists of an aldehyde.

Embodiment 150. The process of Embodiment 149, wherein the aldehyde includes at least one aldehyde selected from the group consisting of a straight-chain aldehyde, a branched aldehyde, and a dialdehyde or polyaldehyde.

Embodiment 151. The process of Embodiment 149 or 150, wherein the aldehyde includes at least one $C_1$-$C_{10}$ aldehyde.

Embodiment 152. The process of Embodiment 142, wherein R includes, mainly includes, consists essentially of, or consists of a carboxylic acid.

Embodiment 153. The process of Embodiment 152, wherein the carboxylic acid includes at least one carboxylic acid selected from the group consisting of a straight-chain carboxylic acid, a branched carboxylic acid, an aryl carboxylic acid, and a dicarboxylic acid or polycarboxylic acid.

Embodiment 154. The process of Embodiment 149 or 150, wherein the carboxylic acid includes at least one $C_1$-$C_{20}$ carboxylic acid.

Embodiment 155. The process of Embodiment 152, wherein the carboxylic acid is a fatty acid.

Embodiment 156. The process of any one of Embodiments 152 to 155, wherein the carboxylic acid is selected from the group consisting of a saturated carboxylic acid, a monounsaturated carboxylic acid, and a polyunsaturated carboxylic acid.

Embodiment 157. The process of any one of the preceding Embodiments, wherein $M^+$ is predominantly $Na^+$.

Embodiment 157A. The process of any one of the preceding Embodiments, wherein $M^+$ is $Na^+$.

Embodiment 158. The process of any one of Embodiments 1 to 156, wherein $M^+$ is predominantly $K^+$.

Embodiment 159. The process of any one of Embodiments 1 to 156, wherein $M^+$ is predominantly $Cs^+$.

Embodiment 160. The process of any one of the preceding Embodiments, wherein the raffinate electrolysis step includes membrane electrolysis.

Embodiment 161. The process of any one of the preceding Embodiments, further comprising separating the lithium-containing aqueous intermediate solution from the stripped organic medium.

What is claimed is:

1. A process for producing a purified aqueous lithium solution from a lithium-containing raw material, the process comprising:

(a) processing the lithium-containing raw material to produce a crude aqueous solution containing lithium sulfate;

(b) in the presence of at least one alkali ($M^+$) hydroxide, contacting said crude aqueous solution with a first organic medium, in an extraction step of a lithium solvent extraction stage, to produce:

(i) a lithium-loaded organic medium; and (ii) a raffinate;

wherein $M^+$ is selected from the group consisting of sodium, potassium, rubidium, and cesium;

(c) in a stripping step of said lithium solvent extraction stage, stripping said lithium-loaded organic medium by means of an aqueous stripping solution containing an acid, to extract said lithium cations from said lithium-loaded organic medium, producing:

(i) the purified aqueous lithium solution; and (ii) a stripped organic medium;

(d) separating the purified aqueous lithium solution from said stripped organic medium;

(e) recycling said stripped organic medium to said extraction stage, said first organic medium including said stripped organic medium;

(f) subjecting said raffinate to electrolysis in a raffinate electrolysis step, to produce:

(i) a hydroxide solution containing said alkali hydroxide, and contaminated with lithium; and (ii) a sulfuric acid stream;

(g) recycling at least a portion of said hydroxide solution for use within the process; and (h) recycling at least a portion of said sulfuric acid stream for use within the process.

2. The process of claim 1, further comprising, prior to said subjecting said raffinate to electrolysis, removing organic matter from said raffinate.

3. The process of claim 1, wherein the concentration of said alkali hydroxide within said hydroxide stream is at most 25%.

4. The process of claim 1, wherein the concentration of sulfuric acid within said sulfuric acid stream is at most 15%.

5. The process of claim 4, wherein the concentration of $M^+$ within said sulfuric acid stream is at least 50 ppm.

6. The process of claim 5, wherein a portion of sulfuric acid in said sulfuric acid stream is recycled to said stripping step.

7. The process of claim 1, wherein a portion of said alkali hydroxide in said hydroxide stream is utilized to produce said crude aqueous solution containing lithium sulfate.

8. The process of claim 1, wherein a portion of said alkali hydroxide in said hydroxide stream is introduced to said extraction stage.

9. The process of claim 1, wherein the concentration of organic matter within said raffinate is at least 20 ppm.

10. The process of claim 1, wherein the concentration of lithium within said raffinate is at least 5 ppm.

11. The process of claim 1, wherein the concentration of lithium within said raffinate is at least 3% of the concentration of lithium within said lithium-loaded organic medium.

12. The process of claim 1, wherein the concentration of lithium within said hydroxide solution is at least 7 ppm.

13. The process of claim 1, wherein the concentration of iron within said sulfuric acid stream is at most 10 ppm.

14. The process of claim 1, wherein the concentration of $M^+$ within said sulfuric acid stream is at least 75 ppm.

15. The process of claim 1, wherein the utilization of said hydroxide solution within the process is at least 20%.

16. The process of claim 1, wherein the total utilization of said hydroxide solution within the raw material processing stage and the lithium solvent extraction stage is at least 35%.

17. The process of claim 1, wherein the utilization of the sulfuric acid stream within the process is at least 30%.

18. The process of claim 1, wherein the total utilization of the sulfuric acid stream within the raw material processing stage and the lithium solvent extraction stage is at least 50%.

19. The process of claim 1, wherein said processing of the lithium-containing raw material includes leaching the lithium-containing raw material with sulfuric acid, and wherein a portion of said sulfuric acid used to effect said leaching of the lithium-containing raw material is utilized from said sulfuric acid stream.

20. The process of claim 1, wherein the total utilization of the hydroxide solution within the raw material processing stage and the lithium solvent extraction stage is at least 35%;

wherein the concentration of sulfuric acid within said sulfuric acid stream is at most 15%;

wherein the concentration of said alkali hydroxide within said hydroxide solution is at most 25%;

wherein the total utilization of the sulfuric acid stream within the raw material processing stage and the lithium solvent extraction stage is at least 50%;

wherein the concentration of $M^+$ within said sulfuric acid stream is at least 50 ppm;

and wherein the concentration of lithium within said hydroxide solution is at least 10 ppm.

* * * * *